United States Patent [19]

Schreder

[11] Patent Number: 4,503,321

[45] Date of Patent: Mar. 5, 1985

[54] CONTROL DEVICE FOR AN ELECTRIC HOTPLATE

[75] Inventor: Felix Schreder, Oberderdingen, Fed. Rep. of Germany

[73] Assignee: E.G.O. Elektro-Gerate Blanc und Fischer, Fed. Rep. of Germany

[21] Appl. No.: 440,733

[22] Filed: Nov. 10, 1982

[30] Foreign Application Priority Data

Nov. 10, 1981 [DE] Fed. Rep. of Germany ..... 3144631
Dec. 15, 1981 [DE] Fed. Rep. of Germany ..... 3149556

[51] Int. Cl.[3] ..... H05B 3/68

[52] U.S. Cl. ..... 219/449; 219/452; 219/445; 219/494; 219/512; 219/513; 337/365

[58] Field of Search ..... 219/398, 445, 446, 449, 219/450, 451, 452, 453, 464, 466, 494, 507, 512, 513; 337/333, 365, 382, 384, 386, 393

[56] References Cited

U.S. PATENT DOCUMENTS

| | | | |
|---|---|---|---|
| 2,830,164 | 4/1958 | Weber et al. | 219/450 X |
| 2,870,313 | 1/1959 | McCormick | 219/452 |
| 3,364,338 | 1/1968 | Holtkamp | 219/398 |
| 4,206,344 | 6/1980 | Fischer et al. | 219/507 |
| 4,386,263 | 5/1983 | Fischer et al. | 219/449 |
| 4,467,180 | 8/1984 | Fischer et al. | 219/449 |

FOREIGN PATENT DOCUMENTS

| | | |
|---|---|---|
| 0031516 | 7/1981 | European Pat. Off. . |
| 664707 | 6/1934 | Fed. Rep. of Germany . |
| 969492 | 10/1954 | Fed. Rep. of Germany . |
| L18895 | 5/1956 | Fed. Rep. of Germany . |
| 972839 | 8/1956 | Fed. Rep. of Germany . |
| 1075761 | 2/1960 | Fed. Rep. of Germany . |
| 1123059 | 2/1962 | Fed. Rep. of Germany . |
| 1192340 | 5/1965 | Fed. Rep. of Germany . |
| 1515131 | 6/1969 | Fed. Rep. of Germany . |
| 1615376 | 5/1970 | Fed. Rep. of Germany . |
| 2118407 | 10/1972 | Fed. Rep. of Germany . |
| 2221874 | 11/1973 | Fed. Rep. of Germany . |
| 2310867 | 9/1974 | Fed. Rep. of Germany . |
| 2347044 | 3/1975 | Fed. Rep. of Germany . |
| 2422684 | 11/1975 | Fed. Rep. of Germany . |
| 7344499 | 5/1976 | Fed. Rep. of Germany . |
| 2557133 | 6/1977 | Fed. Rep. of Germany . |
| 2557194 | 6/1977 | Fed. Rep. of Germany . |
| 2556433 | 6/1977 | Fed. Rep. of Germany . |
| 2604783 | 8/1977 | Fed. Rep. of Germany . |
| 2625715 | 12/1977 | Fed. Rep. of Germany . |
| 2841691 | 3/1980 | Fed. Rep. of Germany . |
| 2943477 | 5/1981 | Fed. Rep. of Germany . |
| 3018416 | 11/1981 | Fed. Rep. of Germany . |
| 587953 | 5/1945 | United Kingdom . |
| 1005604 | 9/1965 | United Kingdom . |

*Primary Examiner*—Volodymyr Y. Mayewsky
*Attorney, Agent, or Firm*—Steele, Gould & Fried

[57] ABSTRACT

Apart from its conventional power main heating system, which is manually controlled by a power control device, an electric hotplate has an additional heating system, which is connected in parallel to the main heating system and in series with a temperature switch and an additional contact, which is operated by the adjusting shaft of the power control device in an upper or medium power range of the hotplate. The temperature switch is a relatively inertly operating thermal cutout with a high switching hysteresis, which in this case serves as a timing element which is not normally switched on again once it has been switched off. Continuously adjustable timing power control units and seven-cycle switches are provided as the power control device.

18 Claims, 9 Drawing Figures

Figure 1:
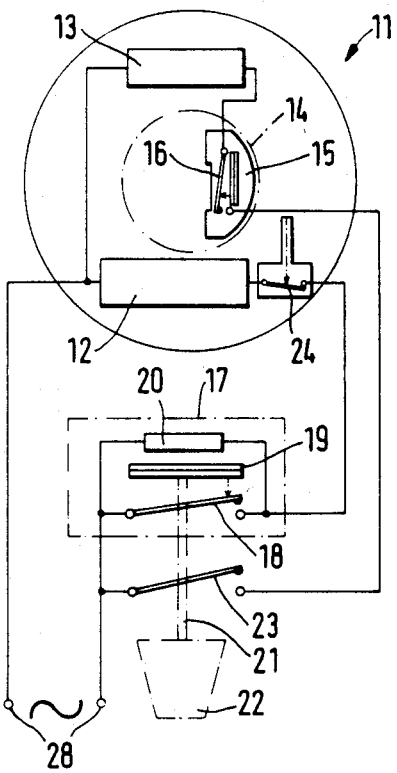

FIG. 5
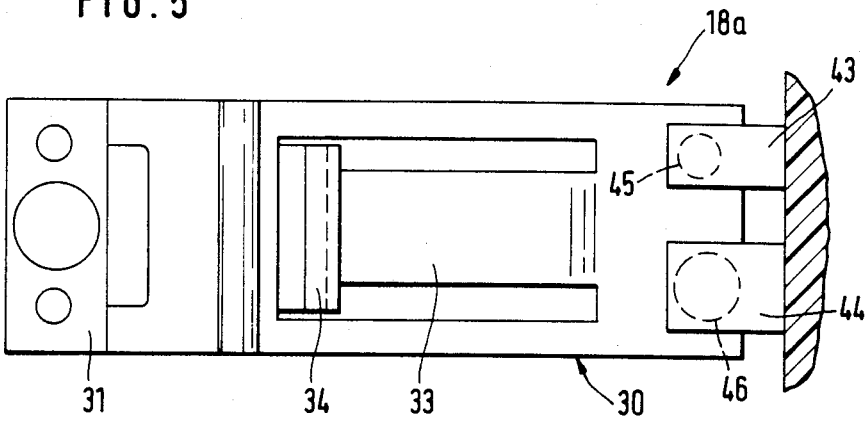
FIG. 6
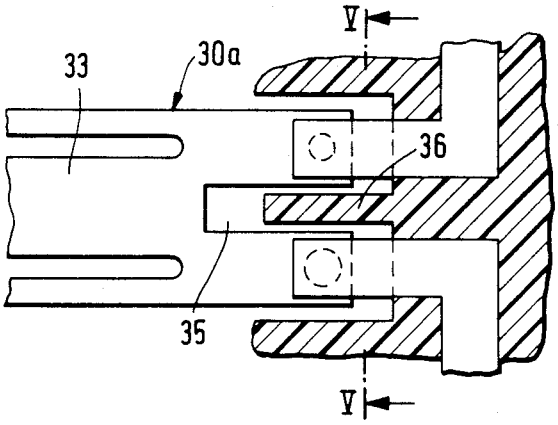
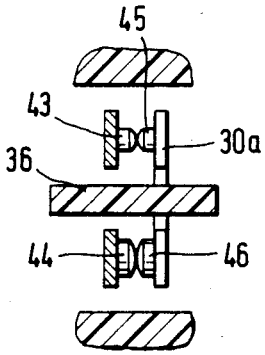
FIG. 7

FIG. 8
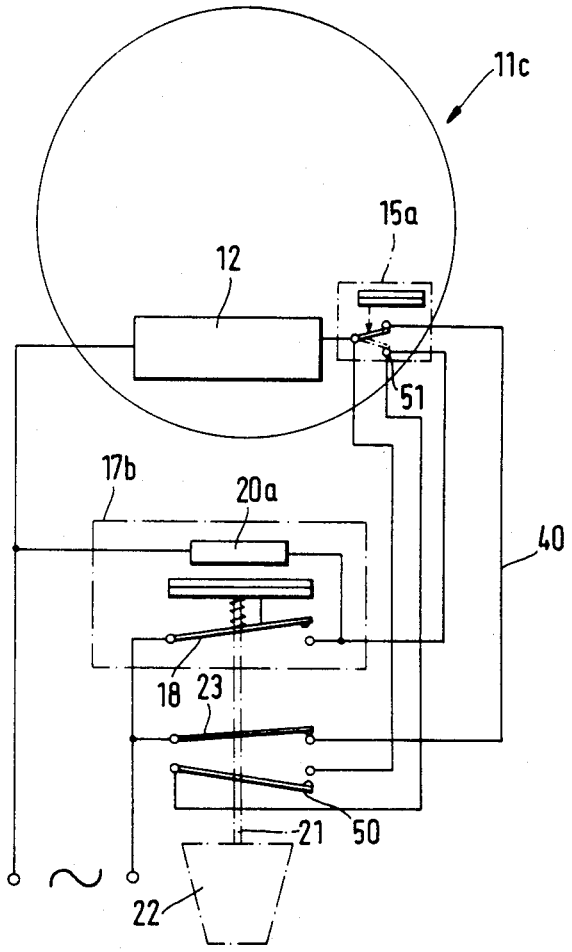
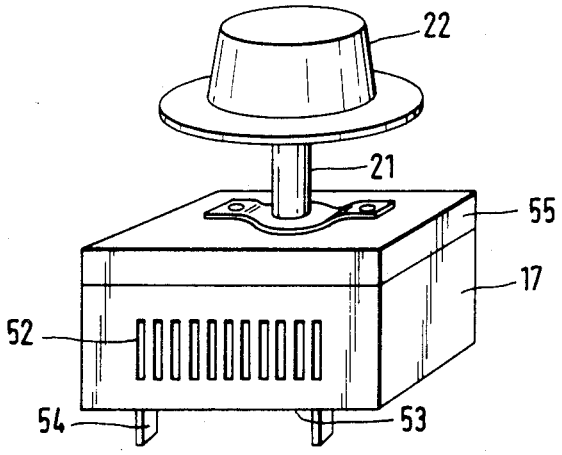
FIG. 9

CONTROL DEVICE FOR AN ELECTRIC HOTPLATE

Electric hotplates according to German Pat. No. 2,310,867 equivalent to British Pat. No. 1,470,296, have a heating system comprising, for example a heating resistor, controlled by a continuously adjustable, timing power control device. In order to speed up the initial cooking in the case of a preselected continuous cooking power, an increased power output is caused by means of a control element contained in the time switch, which often operates thermally. The increased power is either the full installed capacity through bridging the power control device or occasionally is adapted to the particular set cooking stage. In order to release this initial cooking power, a separate switch or pushbutton is operated, or a special manipulation is carried out on the power setting toggle, e.g. the latter is pushed in or pulled out.

It is generally known in connection with electric hotplates to switch off the complete heating system or part thereof by means of a thermal cutout in order e.g. when switching off has been forgotten, to protect the hotplate and its surrounding area against excess temperatures.

Furthermore, the power of conventional electric hotplates is limited for overheating reasons to specific values, which are dependent on the hotplate diameter. The maximum power output for a hotplate diameter of 145 mm are 1000 to 1500 Watt, for a diameter of 180 mm, 1500 to 2000 Watt and for a diameter of 220 mm, 2000 to 2600 Watt (in each case assuming a normal and fast hotplate).

German Pat. Nos. 2,118,407, 2,557,133 and 2,557,194 disclose control devices having temperature switches responding to different temperatures and consequently partly switch off an initial cooking increased power.

Account must be taken of the following specifications in connection with the present invention: German Pat. Nos. 664,707, 1,123,059, 969,492, 972,839; Auslegesschrift Nos. 1,075,761, 1,192,340; Offenlegungsschrift Nos. 1,515,131, 1,615,376, 3,018,416, 2,556,433, 2,221,874, 2,118,407, 2,841,691; British Pat. Nos. 1,005,604; 587,953; U.S. Pat. Nos. 3,364,338, 2,830,164; German Utility Model No. 7,344,449; European Publication No. 0,031,516 and the published German Patent Application No. L18,895.

The problem of the present invention is to provide an easily and readily controllable electric hotplate with an increased initial cooking power and improved controllability.

According to the invention, this problem is solved by a control device for electric hotplates with at least one load heating resistor, an increased power being supplied to the electric hotplate in an initial cooking phase by means of a manually switchable additional switch and which can be switched off by a temperature switch provided on the electric hotplate, wherein the temperature switch is so arranged and has such a high switching hysteresis that, after once being switched off, it is not switched on again in the boiling, roasting or baking range during the further operation of the electric hotplate.

According to a preferred embodiment of the invention, an additional heating system which can be switched off by the temperature switch can be provided in addition to the standard heating system which, in the case of a continuously adjustable power control device, normally comprises a heating resistor and in the case of a seven-cycle plate three heating conductors, which can be connected in by a single manual switching contact. The latter is preferably located on the power adjusting shaft, so that no additional pushbuttons or operating members are required. In accordance with German Pat. No. 1,123,059, to which reference is made here, the temperature switch can be very simply constructed and functions reliably. Through a preferred arrangement in the unheated central area of the electric hotplate, it has a relatively small and high-inertia thermal coupling to the hotplate, so that it switches off with a certain time lag and during normal boiling, roasting or baking does not switch on again. The switching hysteresis is preferably above 50° Kelvin (preferably above 100° K.), with 570° K. (300° Celsius) as the upper response temperature and approximately 420° K. (150° C.) as the lower response temperature.

By cooperation between the electric hotplate, the additional heating system and the temperature switch, over a given time, an increased initial cooking power is released and this is then permanently switched off, because it is ensured that the additional heating system is only operatively connected in the middle to upper power range, i.e. the temperature switch is not switched on again during normal boiling, roasting or baking. The automatic initial cooking means created in this simple manner is also to a certain extent dependent on the power removed, for example whether a large cooking utensil with a large number of cold products to be cooked is placed on the electric hotplate, or whether a small utensil with few and easily heated products are placed thereon. The greater the power removed, the greater the delay in the heating of the hotplate and the longer the additional heating system remains connected in. This leads to a functional advantage compared with the hitherto conventional initial cooking system, which functions completely independently of the hotplate.

It is possible to choose a higher overall power consumption of the electric hotplate, including the additional heating system than the power conventionally associated with the particular hotplate diameter. Thus, e.g. in the case of a diameter 180 mm hotplate, the power of the main heating system can be reduced from 1500 to 1200 Watt and a further 1200 Watt can be connected as an additional heating system, so that said hotplate comes to a maximum power of 2400 Watt, so that initial cooking takes place very rapidly. However, no overheating need be feared in spite of this high power, because the temperature switch ensures that the additional heating system is switched off after the initial cooking phase. In addition, the hotplate could be protected by a conventional thermal cutout, which then preferably operates in a low-inertia manner with a low switching hysteresis and which can wholly or at least partly switch off the main heating system.

The control element can, for example, be a timing power control unit which, in a timing manner, controls the undivided main heating system with a continuously adjustable relative switch-on time. The invention offers particular advantages in connection with this arrangement, because it makes it possible to raise the power over a given absolute maximum limit, which is normally approximately 1800 Watt. If a higher power is controlled by means of an energy regulator, the limit is normally exceeded, which is considered as allowable due to the radio interference resulting from the switching-off processes. Particularly in the case of several hotplates, the permitted disconnection rate could be exceeded. The invention makes it possible to obtain a high power, without the power control device having to control the complete installed capacity.

It is possible in this embodiment, to connect in the additional heating system in the next power stage of the control element. The associated toggle position, which is at the end of the power setting range and which can be marked e.g. by a notch in addition to an optical signal, consequently represents a kick-down position permitting a rapid heating of the products being cooked and, after the initial cooking phase, automatically switches back to the conventional installed capacity.

In a particularly preferred manner, the control element is a manually operable multiple cycle switch, preferably a seven-cycle switch, with which is associated a contact, which switches on the additional heating system in addition to the heating resistors forming the main heating seven-cycle. Thus, in the case of a seven-cycle plate, in addition to the three main heating resistors, there is an additional heating resistor, which provides an automatic initial cooking means e.g. in an eighth switch position (with the conventional toggle graduations of 1 to 3, beyond 3 or at 3).

However, the invention is not only usable for speeding up initial cooking in the case of an overall power extending beyond the conventional level, but instead it enables a finer graduation of the power setting. Thus, on connecting in the additional heating system, even in a medium power range, e.g. by limiting the power to be controlled by the power control device or a multiple cycle switch, it is possible to improve the controllability of very low power levels for keeping hot or heating sensitive foods, such as porridge, because this leads to a low power with a higher relative switch-on duration.

According to an embodiment, the power control device, i.e. its switching contact switching the load current in timed manner, can be bridged by a contact of a temperature switch connected parallel thereto, so that in the case of a closed contact, the load heating resistor of the electric hotplate receives the full power, although the power control device is set to a lower value and optionally also has its switching contact open. During the initial cooking phase, i.e. the contact of the temperature switch is still closed, the power control device could continue to function. If the control heating system of the expansion element (bimetal) of the timing power control device is connected in series with the load by a current coil, the power control device does not operate during this phase, i.e. its contact is also closed, because the current coil is not heated and therefore the bimetal cannot open the switch. The normal working cycle of the power control device would only commence with a "on phase" after the response of the temperature switch.

If, as sought, a voltage coil connected in parallel to the load is used, which enables the number of types to be kept smaller, in the case of this circuit it would be continuously switched on during this initial cooking phase and would consequently switch off the power control device. Although admittedly the switch is bridged, due to the permanent switching on of the control heating system, there could be an overheating of the power control device and in particular an excessive deflection of the bimetal and consequently of the snap-action switch.

To avoid this, particular preference is given to the switch of the power control unit being designed in such a way that, preferably by arranging two separate cooperating contacts for the switching contact, the control heating system is separated from the circuit leading from the power control unit to the load on opening the switch. The control heating system only then receives voltage, if the switch of the power control unit is closed, when the switch spring with its two contacts brings about a bridging effect between the two cooperating contacts. Thus, during the initial cooking phase, the power control unit "idles", which is unimportant. However, there is no overheating or switch bridging.

This is particularly important if a diode is connected upstream of the control heating system and which acts in the higher power setting range of the power control unit and reduces there the power consumption of the control bimetal or the power control unit, in the manner described in Auslegesschrift No. 2,625,715 (U.S. Pat. No. 4,206,344), to which express reference is made here. In the lower power setting range, the diode is bridged or inactive, so that then the double bimetal heating power is present, which would lead more easily to the previously described and feared phenomena.

The arrangement of the two contacts on the switch of the power control unit can preferably take place through using a single double snap-action switch with a snap spring having a free end on which two contacts are juxtaposed in parallel and which cooperate with two fixed, electrically insulated opposing contacts. A precisely simultaneous switching of the two contacts is ensured, so that there is only one switching on or off surge in the mains. Preferably, the snap spring is forked at the free end and an insulating web, which reliably electrically separates the two contacts from one another, is arranged in the gap.

However, it is also possible to use a double snap spring, i.e. a snap spring having a support in the central area and containing two free ends, each having a contact. Its operating pressure point is in the central area. In this case, a precisely simultaneous snap-over cannot be ensured for each setting, but it is possible to intentionally provide an earlier or later snap-over on one or other side, in order to switch the control heating system of the power control unit earlier or later than the load. The double snap-action switch can be constructed in the manner described in German Pat. No. 2,422,684, to which express reference is made.

However, it is also possible to construct the temperature switch as a reversing switch, which reverses between the circuit applying the consumer heating resistor to the mains via the additional contact, and the circuit containing the power control unit and the load heating resistor. Here again, the control heating system of the power control unit can be connected parallel to the load heating resistor. However, if the additional contact is only connected in during part of the power range of the power control unit, i.e. not continuously during operation, an auxiliary contact must be associated with the additional contact and which is switched opposite thereto and which ensures that when the thermal cutout is disconnected and the additional contact is switched off, the circuit is closed via the power control unit and the load heating resistor. Preferably, in all constructions, the additional contact is coupled to the adjusting shaft in such a way that it is connected in in an upper power range of the power control unit, but remains switched off in power ranges below the standard initial cooking power (usually below a quarter of the installed capacity of the hotplate).

The initial cooking phase is preferably provided in the boiling, roasting and baking range of the power control unit, but not in the warming range. The position of these ranges is dependent on the size, nature and maximum power of the hotplate. However, as a standard value it can be assumed that in the warming range, in which there is normally no initial cooking phase, the power setting is so low that the cooking product temperature does not exceed 100° C. (373° K.).

In place of the above-described thermal cutout which, due to its great switching hysteresis, does not switch on again and consequently has a good and adequate action with minimum product expenditure, the temperature switch can be constituted by any other such switch, particularly those having a disconnection delay. It would also be conceivable to use a temperature switch which, due to a large contact gap on its snap-action switch, after operating once does not jump back into the initial position and is only returned to the latter mechanically when the adjusting shaft is in the neutral position.

An advantage of the invention is that conventional power control devices or power regulators can be used, if an additional contact or switch is associated therewith. This is preferably brought about in that the additional contact is contained in an attached switch casing to the power control device, which is mounted on the device casing on the operating side and through which projects the common adjusting shaft.

Preferred embodiments of the invention are described in greater detail hereinafter and certain advantageous combinations are shown. However, to reduce the number of examples, other feature combinations are not shown and described in detail, although they may be advantageous. In the drawings, show:

FIGS. 1 to 4 and 8 circuit diagrams of embodiments of control devices with associated electric hotplates.

Figure 2:
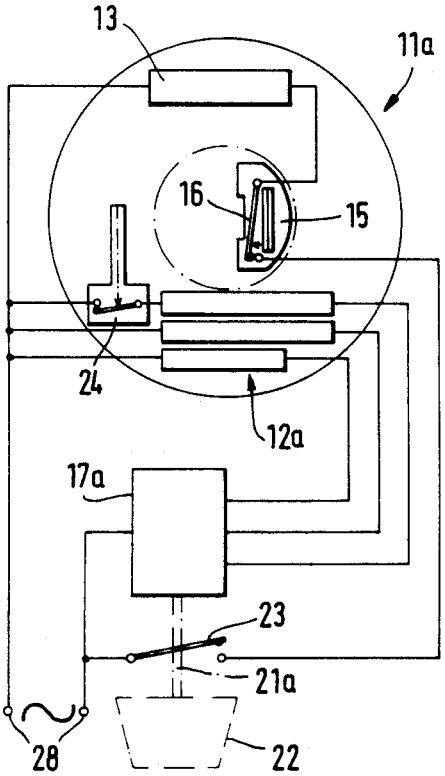

FIG. 5 a plan view of the snap spring of the switch of the power control device according to FIG. 2.

Figure 3:
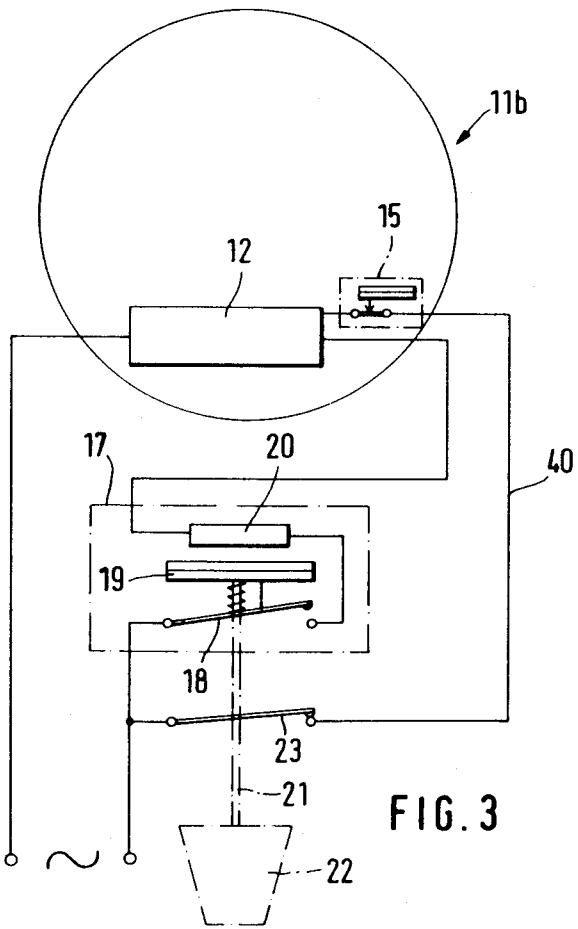

FIG. 6 a preferred variant of FIG. 3.

Figure 4:
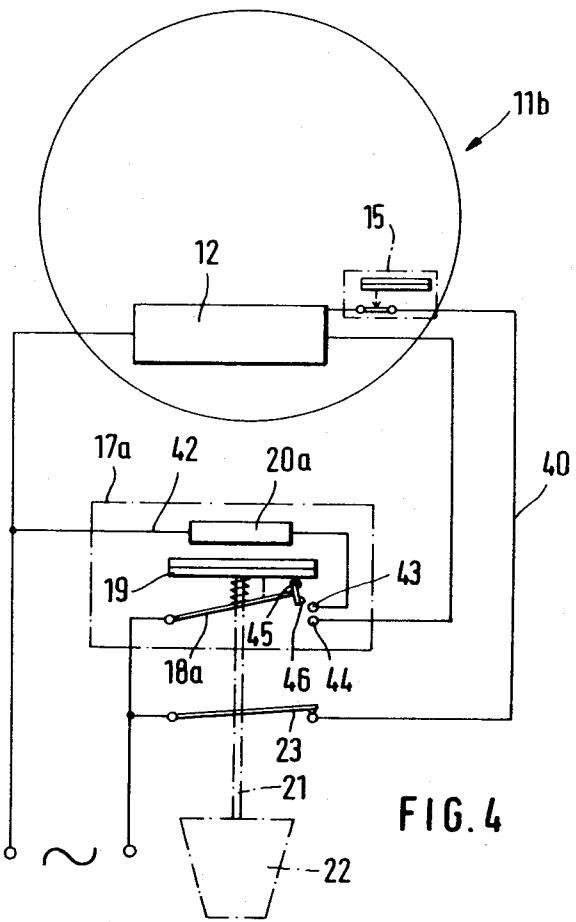

FIG. 7 a section along line V—V of FIG. 4.

FIG. 9 a perspective view of a control device.

In the drawings, the same parts carry the same references and comparable or functionally identical parts are additionally provided with a small following letter and thus reference is made to their description in connection with other embodiments.

FIG. 1 shows an electric hotplate 11 of conventional construction with a hotplate body made from a cast material with an upper flat cooking surface and which is not shown in detail. A main heating system 12 is provided, which comprises one or more parallel or series-connected heating resistors, which are embedded in slots on the underside of the hotplate body. The invention can be used with particular advantage in conjunction with such hotplates, but can also be used with glass ceramic cooking means. The main heating system 12 is arranged together with an additional heating system 13 in a ring area of the hotplate, which leaves free in the center an unheated zone 14 in which is arranged a temperature switch 15. The latter is a thermal cutout which, in a conventional half-moon or crescent-shaped ceramic casing, has a bimetal and a snap-action switch 16 operated by the latter. Due to its crescent shape, temperature switch 15 can be readily arranged in the area of the unheated metal zone, without covering the normal central boot for fixing the hotplate. The main heating system 12, which, like the additional heating system 13, optionally passes in a number of turns around the hotplate is connected to the domestic mains 28 by means of a power control device 17. The conventional, timing power control device 17 has a snap-action switch 18, a bimetal 19 operating the latter and a control heating system 20 for the bimetal and which is connected in series with switch 18. It is continuously adjustable by an adjusting toggle 22 via an adjusting shaft 21. The latter also operates a switch 23, which is advantageously closed from the stage at which the warming range stops and the continuous cooking range commences (e.g. with a 180 mm diameter hotplate as from 200 Watt). This range begins at setting 4 in the case of the conventional scale division on the adjusting knob of 1 to 12. Switch 23 is in series with switch 16 of the temperature switch 15 and additional heating system 13. This strand with the additional heating system is consequently connected in parallel to the main heating system and the power control unit and is electrically independent. The standard mechanical switching contacts for the all-pole separation of the hotplate from the mains in the zero position are not shown.

In the case of a power setting in the warming range, the additional heating system is switched off, but the settability of very small power levels is improved. If the power control device can still reliably control e.g. a relative switching-on time of 8%, this only represents 96 Watt, i.e. 4% of the total power.

On setting a power level, at which switch 23 is closed, in addition to the particular partial power of the main heating system 12, the complete additional heating system 13 is switched on, which leads to very rapid initial cooking. As a function of the coupling of the temperature switch 15 to the temperature of the hotplate in greater or lesser dependence on the removed power, after a time of e.g. 6 minutes, the temperature switch 15 responds and the additional heating system 13 is switched off again, even if subsequently the power is reduced to maintain the cooking state, by resetting the power control device, the temperature switch 15 remains off, so that the additional heating system remains ineffective until the hotplate is out of operation and has largely cooled. A high hysteresis of the temperature switch is advantageous for this purpose. This switching temperature difference between the disconnection and reconnection states, should be 50° K., preferably 100° to 150° K. and makes it possible to use a particularly simple and reliable temperature switch. The latter can be constructed according to German Pat. No. 1,123,059, to which reference is made. Thus, for the present case, there can be a disconnection temperature of approximately 620° Kelvin (equivalent to approximately 350° Celsius or 660° Fahrenheit) and a reconnection temperature of approximately 530° Kelvin (equivalent to approximately 260° Celsius or 490° Fahrenheit). For purposes of convenience, it is noted that a given temperature stated in Kelvin degrees will be approximately 273° greater than the same temperature stated in Celsius degrees, while temperature differences (e.g. hysteresis) will be equal for both temperature scales.

The main heating system 12 is protected by an additional thermal cutout 24 with a lower switching hysteresis and which prevents heat damage to the hotplate through the main heating system, which has in error been switched on at a higher power level, remaining on.

FIG. 2 shows a hotplate 11*a* of the same basic construction, whose main heating system 12 comprises three individual and in part differently sized heating resistors which are connected to a conventional seven-cycle switch 17*a*, shown only in block form, and which by rotating the adjusting shaft 21*a* can be individually connected in series and parallel, so that six power stages can be obtained. Such a switch is described in German Pat. No. 2,604,783 (equivalent to British Pat. No. 1,577,852), to which reference is made. In the case of an electric hotplate with a diameter of 180 mm, e.g. the main heating system 12*a* could have 1200 Watt in the divisions 600, 400, 200 Watt and the additional heating system 1300 Watt. This leads to a minimum power of only 110 Watt and such a low value could not hitherto be achieved with a high power hotplate with a seven-cycle circuit. Even on leaving the power in the hitherto conventional range, e.g. 2000 Watt in the division 1000:1000 Watt, compared with the hitherto conventional constructions the advantages of rapid initial cooling without switching up and down on the part of the operator and the finer setting possibility over the entire warming and continuous cooking range are maintained (lowest power below 100 Watt). Even large hotplates for restaurants can be improved in use, in that e.g. a square 300×300 mm hotplate receives an additional heating system of 1500 Watt, besides the seven-cycle 2500 Watt, so that faster heating is possible. In the represented example, the resistors of the main heating system can be disconnected by means of a thermal cutout which, as in FIG. 1, has a low inertia and can be easily coupled to the temperature of the hotplate heating system.

The additional heating system 13 is connected in the same manner as in FIG. 1 via temperature switch 15 and switch 23 parallel to the strand of the main heating system and independently thereof. In one case, switch 23 is closed by the adjusting shaft 21 or a trip cam arranged thereon, if the switch is at or beyond the maximum power level of the normal seven-cycle switch. The additional heating system then cooperates with the temperature switch as an automatic initial cooking means in the manner described hereinbefore. In addition, a particularly fine adjustability is achieved on switching in the additional heating system at one of the upper power stages and advantageously as from the start of the continuous cooking range (as from setting 2 on the conventional scale of 1 to 3). It can be assumed that these power stages are normally only used for initial cooking processes, because there are scarcely any boiling, baking or roasting processes which require the complete power of the main heating system as continuous power. Through corresponding optical demarcation on the adjusting knob, the higher stages for initial cooking processes can be made to stand out.

Thus, a particularly simple possibility is provided for increasing the power or reducing the heating time of a hotplate and which also provides an automatic initial cooking means. It is particularly advantageous that, from the operation side, it can be completely integrated into a single manual setting member for power and automatic initial cooking means, so that a particularly advantageous and simple operation is obtained.

In the embodiment of FIG. 3, the load heating resistor 12 of an electric hotplate 11*b* is connected in series with the switch 18 of a timing power control device 17. The control heating system 20 is in this case connected in series with the load heating resistor 12.

Parallel to the power control device 17 is connected a bridging line 30, which contains the manually switchable additional switch 23 and the contact 16 of temperature switch 15, which is normally closed, i.e. in the lower temperature range. As a function of the desired operation, additional contact 23 is closed throughout the entire or part, preferably the upper part, of the power setting range of the power control device. If the previously cold hotplate is brought by means of the adjusting knob 22 into a power range in which contact 23 is closed, the power control unit 17 is bridged and despite the then closed switch 18, control heating system 20 remains currentless. Thus, the total power acts on the hotplate until the temperature switch 15 responds and the hitherto closed contact opens. The full power then flows through the load heating resistor 12 until the control heating system 20 deflects the expansion element 19 to such an extent that the switch 18 opens. This is followed by the conventional timing operation of the power control unit as a function of its power setting. At least in an upper power range, temperature switch 15 remains permanently off, so that the bridging branch 40 is then ineffective.

In the embodiment of FIG. 4, there is the difference that the power control device 17*a* contains a control heating system 20*a*, which is connected in parallel to the load heating resistor, i.e. it operates in a voltage-dependent and not a current-dependent manner, as in FIG. 3. The parallel branch 42 containing the control heating system is connected to a fixed cooperating contact 33 of switch 17*a* of the power control unit, while the load heating resistor is connected to an electrically separated, fixed cooperating contact 44. Switch 18*a* contains two movable contacts 45, 46, which jointly and simultaneously can contact the two fixed cooperating contacts 43, 44.

The operation is as described in FIG. 3. Here again, when the additional contact 23 is connected, the power control unit 15*a* is bridged and consequently remains ineffective for the hotplate control until the temperature switch 15 is open. Since on switching on the hotplate, switch 18*a* is closed, the control heating system 20*a* connected in parallel to the load is switched on, and via expansion element 19 still operates switch 18*a* for a certain time. However, when it is switched off, the parallel circuit 42 is opened, so that the expansion element 19 is then cooled. Thus, the power control unit 17*a* also operates during the initial cooking phase, but exerts no action on the control of the hotplate. Only when the temperature switch 15 is opened does switching over automatically take place to the power timed by the power control unit.

FIG. 5 is a plan view of snap spring 30 of switch 18*a* according to FIG. 2. At one end 31, it is fixed to a snap-action switch support and is connected to a pole. Snap spring 30 made from a thin resilient material has a marked toroidal groove on which acts the actuating element, i.e. expansion element 18 and has a spring tongue 33 directed from its free end 32 to the fixed end 30 and separated by a U-shaped cutout and supports the snap-action switch support on a step bearing 34 projecting through the cutout.

The two contacts 45, 46 are juxtaposed on the free end 32 and cooperate with the two cooperating contacts 43, 44, when the snap-action switch is closed. As contact pair 43, 45 only has to switch the power of control heating system 20*a* of a few Watts, it can be made less strong than contact pair 44, 46.

The embodiment of a snap spring 30*a* in FIGS. 6 and 7 has an identical construction. Only the end of the snap spring is forked into two parallel portions by a notch 35 into which projects an insulating web 36 of the casing. The relatively flexible portions carrying the contacts ensure that a good contact of both contact pairs is possible, even in the case of non-uniform contact wear.

The embodiment of FIG. 8 has a temperature switch 15*a* having a contact 51 acting as a reversing switch. An auxiliary contact 50 is associated with additional switch 23 and is connected to the latter via adjusting shaft 21, but in an opposite direction, so that it is always open when the additional contact 23 is closed, and vice versa. Power control device 17*b* corresponds to device 17 of FIG. 3, so that it also has a snap-action switch 18 with only a single contact pair, but control heating system 20*a* is connected in parallel to the load heating resistor 12. The power control device is applied to the changeover contact 51 of the temperature switch 15*a*, which is therefore closed, when the temperature switch has switched off the bridging branch 50 via additional contact 23 on reaching its switching temperature. The auxiliary contact 50 bridges temperature switch 15*a*, if the latter has not yet reached its response temperature.

On switching on the cold hotplate 11*c* in a range in which the additional switch 23 is closed, the load heating resistor 12 is heated with full power via bridging branch 40. The power control device 17*b* is disconnected, because temperature switch 15*a* does not close the changeover contact 51 and auxiliary contact 50 is also disconnected. On switching over temperature switch 15*a* after it has operated, the parallel branch 40 is switched off and the power control device 17*b* switched on and then supplies power in the normal timed manner.

If the hotplate is set in such a way that the additional contact 23 is open, i.e. there is no initial cooking phase with full power, then the auxiliary contact 50 is closed and ensures that the power control device is effective even if temperature switch 15*a* has not been switched over. Additional contact 50 can be eliminated if, over the complete power range of power control unit 17*b*, an initial cooking aid is provided. However, this is not generally desired because, on setting very low power levels, the resulting initial heating would be too great.

FIG. 9 is a perspective view of the power control device 17 which, with its bimetal heating system vented by air slits 52, is housed in a block-like plastic casing. On the operation-remote back 53 there are wall plugs 54 and optionally a diode. The setting shaft 21 projects through the power control device 17 and a casing 55 for additional switch 23 mounted on the operating side. The flat casing 55 of the additional switch can receive a trip cam mounted on the adjusting shaft 21 and switch 23 constructed as a resilient contact lug. Mounting can take place by snapping or screwing onto the casing of power regulator 17 and the electrical connections can be internal and direct by means of plugs.

What is claimed is:

1. A control device for an electric hotplate with at least one load heating resistor, an increased power being supplied to the electric hotplate in an initial cooking phase by means of a manually switchable additional switch and which can be switched off by a temperature switch provided on the electric hotplate, wherein the temperature switch is so arranged and has such a high switching hysteresis that, after once being switched off, it is not switched on again in boiling, roasting and baking ranges during further operation of the electric hotplate.

2. A control device according to claim 1, wherein in addition to a main heating system comprising said at least one heating resistor, there is an additional heating system for the electric hotplate, which can be connected parallel to the main heating system in a middle to upper power range and can be disconnected by the temperature switch.

3. A control device according to claim 2, wherein total power consumption of the electric hotplate, including the additional heating system, exceeds a power consumption conventionally associated with a hotplate of equal diameter.

4. A control device according to claim 2, wherein the main heating system is timed and power-controlled and wherein power consumption of the main heating system is below a power consumption conventionally associated with a hotplate of equal diameter.

5. An electric hotplate according to claim 2 wherein the control device contains manually operable multiple cycle switches, with which is associated a contact forming the additional switch, which switches the additional heating system in addition to the heating resistors forming the main heating system.

6. A control device according to claim 1 for an electric hotplate with a load heating resistor receiving the total power supplied to the hotplate and with a timing power control device, wherein the additional switch is connected to bridge the power control device, the additional switch being in parallel with the temperature switch.

7. A control device according to claim 6, wherein the power control device has a control heating system connected in parallel to the load heating resistor and the switch of the power control device operates two separate switching contacts for the load heating resistor and the control heating system, the switch of the power control device being a snap-action switch, having a snap spring carrying two contacts which cooperate with two electrically separate, fixed cooperating contacts.

8. A control device according to claims 6 wherein the temperature switch contains a reversing switch which, when the temperature switch operates, switches over from a current branch containing the additional switch to a circuit containing the power control device, an auxiliary contact being associated with the additional switch and switching in opposite sense to the latter, and when the additional switch is off and the temperature switch has not operated, switches the power control device in a circuit having the load heating resistor.

9. A control device according to claim 1, wherein the additional switch is located in a switch casing attached to the power control device which, on an operating side of the latter, is mounted on a casing thereof, through which passes a common adjusting shaft.

10. A control device according to claim 1, wherein the temperature switch is an inertly operating thermal cutout with a high switching hysteresis of over 50° C., preferably over 100° to 150° C.

11. A control device according to claim 1, wherein the temperature switch and a temperature-sensitive element thereof are arranged in a central upheated area of the electric hotplate with limited thermal coupling thereto.

12. A control device according to claim 2, wherein the temperature switch is provided in addition to a thermal cutout at least partly associated with the main heating system.

13. An electric hotplate according to claim 1, wherein as from a medium power setting, the additional heating system can be connected to control a time-limited initial cooking power.

14. The control device of claim 6, wherein the temperature switch is operable by a common adjusting shaft with the power control device.

15. The control device of claim 7, wherein the fixed cooperating contacts are juxtaposed at a free end of the snap spring.

16. The control device of claim 7, wherein a free end of the snap spring is forked.

17. The control device of claim 10, wherein the temperature switch has a switching hysteresis over 100° to 150° C.

18. The control device of claim 16, further comprising an insulating web engaging in a gap resulting from the forked end of the snap spring.

* * * * *